US007040407B2

(12) United States Patent
Jennings et al.

(10) Patent No.: US 7,040,407 B2
(45) Date of Patent: May 9, 2006

(54) COLLET LOAD SHOULDER

(75) Inventors: Charles E. Jennings, Houston, TX (US); Alireza Shirani, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 305 days.

(21) Appl. No.: 10/656,697

(22) Filed: Sep. 5, 2003

(65) Prior Publication Data

US 2005/0051337 A1 Mar. 10, 2005

(51) Int. Cl.
*E21B 7/12* (2006.01)

(52) U.S. Cl. ..... 166/348; 285/123.4; 166/75.14; 166/368

(58) Field of Classification Search ..... 285/123.4, 285/123.3; 166/348, 368, 75.14
See application file for complete search history.

(56) References Cited

U.S. PATENT DOCUMENTS 4,355,825 A * 10/1982 Leicht ..... 285/3
4,460,042 A 7/1984 Galle, Jr.
4,528,738 A 7/1985 Galle, Jr.
4,534,583 A * 8/1985 Milberger et al. ..... 285/24
4,903,992 A 2/1990 Jennings et al.
5,020,593 A 6/1991 Milberger
6,125,939 A 10/2000 Abreo, Jr.
6,302,211 B1 10/2001 Nelson et al.
6,598,673 B1 7/2003 Hosie et al.
2002/0096878 A1 7/2002 DeBerry et al.

* cited by examiner

*Primary Examiner*—William Neuder
*Assistant Examiner*—Nicole Coy
(74) *Attorney, Agent, or Firm*—Bracewell & Giuliani LLP

(57) ABSTRACT

In a subsea wellhead assembly, a collet ring assembly is used with a hanger for suspending a string of conduit in a subsea wellhead assembly. The ring assembly includes a collet that extends around an outer surface of the hanger. The collet has an upper portion that rotates radially between locked and unlocked positions. The ring assembly has a protruding lower portion extending radially outward from the hanger for engaging an interior surface of the wellhead assembly, which causes the upper portion of the collet to rotate radially outward to engage the interior surface of the wellhead assembly in a locked position. The ring assembly includes a back-up ring that engages the interior of the collet, which the collet rotates around between its locked and unlocked positions.

12 Claims, 4 Drawing Sheets

COLLET LOAD SHOULDER

BACKGROUND OF THE INVENTION

1. Field of the Invention

The present invention relates generally to devices for connecting a tubular member with a tubular housing, and in particular to a locking ring that connects a casing hanger to a wellhead housing.

2. Background of the Invention

Generally a subsea high pressure wellhead housing has a landing shoulder within it for supporting a string of casing. The landing shoulder results in the portion of the bore below it being smaller in diameter than the bore portion above it. The reduced diameter of the lower portion of the bore limits the size of casing that can be ran through and supported in the wellhead housing. If a second casing string is required for a deeper portion of the well, it would have to pass through the first string. The diameter of the second string limits the size of tubing, pumps and the like that will be run through it. To avoid very large diameter wellhead housings, operators desire to minimize the difference between the final string of casing and the bore of the wellhead housing.

One type of subsea wellhead assembly employs a high pressure wellhead housing that has a bore does not have a significantly reduced diameter portion below a landing shoulder, and is thus considered "full bore". This type of wellhead allows a larger diameter final string of casing than one that employs a landing shoulder.

In one prior art type, an annular recess is formed in the bore of the wellhead housing. A small shoulder is placed in the bore to serve as a locator. When it is desired to run the first string of casing, the operator runs a shoulder ring into wellhead housing bore on a running tool, lands on the locator shoulder and affixes the ring in the recess. The operator then runs the first string of casing and lands a conventional casing hanger on the shoulder ring.

In another method, a shoulder ring is installed in a retracted position in the wellhead housing, then the wellhead housing is run. Subsequently, the operator runs a tool that moves the shoulder ring from the retracted position to an operational position. Both of these methods require an extra trip into the wellhead housing, which is costly in deep water.

In another type, upper and lower shoulder rings are installed on the casing hanger. The upper shoulder ring is split, thus radially expansible, while the lower shoulder ring is solid. An upper landing shoulder is located in the recess and a lower landing shoulder is located below. The operator runs the casing and casing hanger with the upper shoulder ring in a retracted position. The lower shoulder ring lands on the lower landing shoulder and cams the upper shoulder ring outward into the upper landing shoulder in the recess. The shoulder rings share the load, thus the lower landing shoulder needs to be large enough to support a portion of the load. Since the lower landing shoulder only supports part of the load, it may be smaller in radial width than a conventional load shoulder, but it is greater in width than a shoulder that serves merely to locate.

SUMMARY OF THE INVENTION

In the subsea wellhead of this invention, a recess is formed in a bore of a tubular wellhead member or housing, the recess having at least one landing shoulder and an upward facing ledge. A collet is located on an outer surface of a hanger for supporting a string of conduit in the subsea well. The collet has a protruding lower portion that extends radially outward from the hanger. The protruding lower portion engages the upward facing ledge of the recess formed in the bore of the wellhead member. Once engaged, continued downward movement of the casing hanger causes an upper portion of the collet to rotate radially outward and engage the landing shoulder in the recess. Downward load transmits through the landing shoulder.

Preferably, the collet comprises a ring with slots cut in a serpentine-shape to allow the ring to expands radially. The collet ring assembly also includes a back-up ring that engages a recess formed on the inner surface of the collet. The collet rotates around the back-up ring between the locked and unlocked positions. A wedge surface on the casing hanger slides downward relative to the back-up ring as the collet rotates about the back-up ring. Preferably, grooves are formed around the upper portion of the collet for engaging multiple landing shoulders in the recess in the wellhead member.

In one embodiment, a split ring is mounted on the lower portion of the collet and biased outward. The split ring engages the locator shoulder as the casing hanger is run into the wellhead housing.

DETAILED DESCRIPTION OF THE PREFERRED EMBODIMENT

Figure 1:
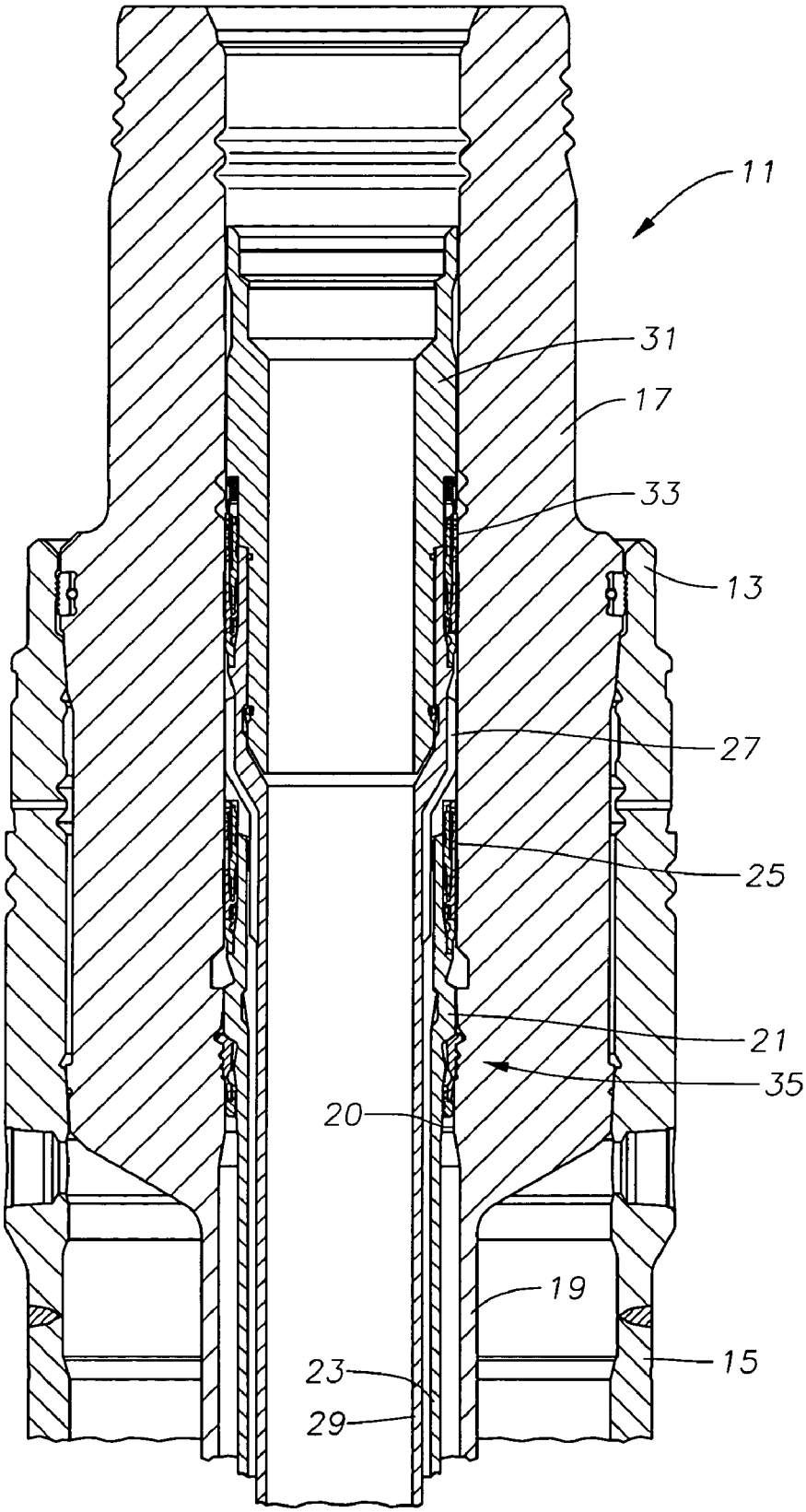
FIG. 1 is an overall sectional view of an upper portion of a wellhead assembly constructed in accordance with this invention.

Referring to FIG. 1, a subsea wellhead assembly 11 includes a low pressure or outer wellhead housing 13 with a string of conductor casing 15 extending from its lower end to a desired depth within the well. A high pressure or inner wellhead housing 17 with a string of casing 19 extending from its lower end lands within low pressure wellhead housing 13. Casing 19 extends to a deeper depth within the well. High pressure wellhead housing 17 has a bore 20 extending axially therethrough. In the preferred embodiment, bore 20 has a predetermined diameter defining a "full bore" diameter for wellhead assembly 11. That is, there are no significant reductions in inner diameter throughout bore 20. In the example shown, casing 19 has a slightly larger bore diameter than high pressure wellhead housing 17.

Casing hanger 21 with a first intermediate string of casing 23 extending below is lowered into and lands in bore 20 of high pressure wellhead housing 17. After cementing, a pack-off or casing hanger seal 25 is moved into a sealing position between casing hanger 21 and bore 20. In the preferred embodiment, a hanger 27 with a second string of intermediate casing 29 is lowered into and landed in bore 20 above casing hanger 21. Optionally, a wear bushing 31 may land in bore 20 of high pressure wellhead housing 17 above hanger 27. A casing hanger pack-off 33 sealingly engages bore 20 between hanger 27 and bushing 31. The tubing and its connection to bushing 31 is not shown in FIG. 1. In other types of subsea wells, the tubing hanger lands in the Christmas tree (not shown), which is subsequently landed on wellhead housing 17.

Figure 3:
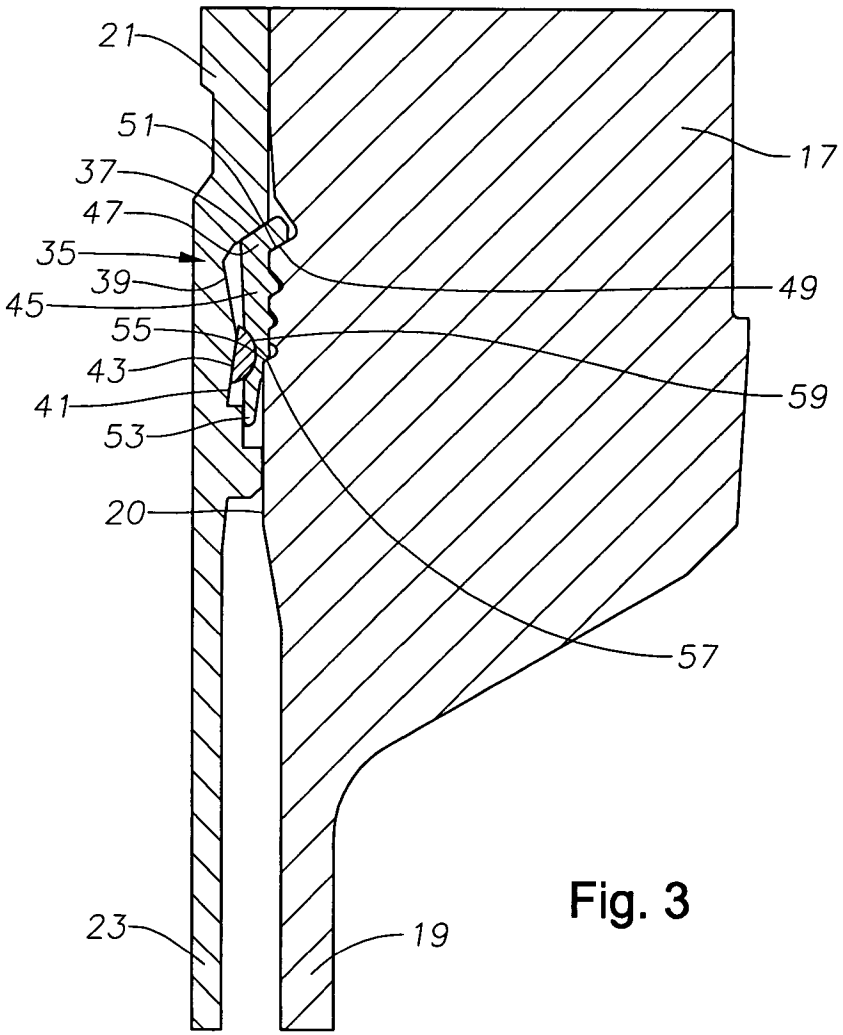
FIG. 3 is an enlarged sectional view of the wellhead assembly shown in FIG. 1, with the collet ring assembly shown in its locked position.
Figure 2:
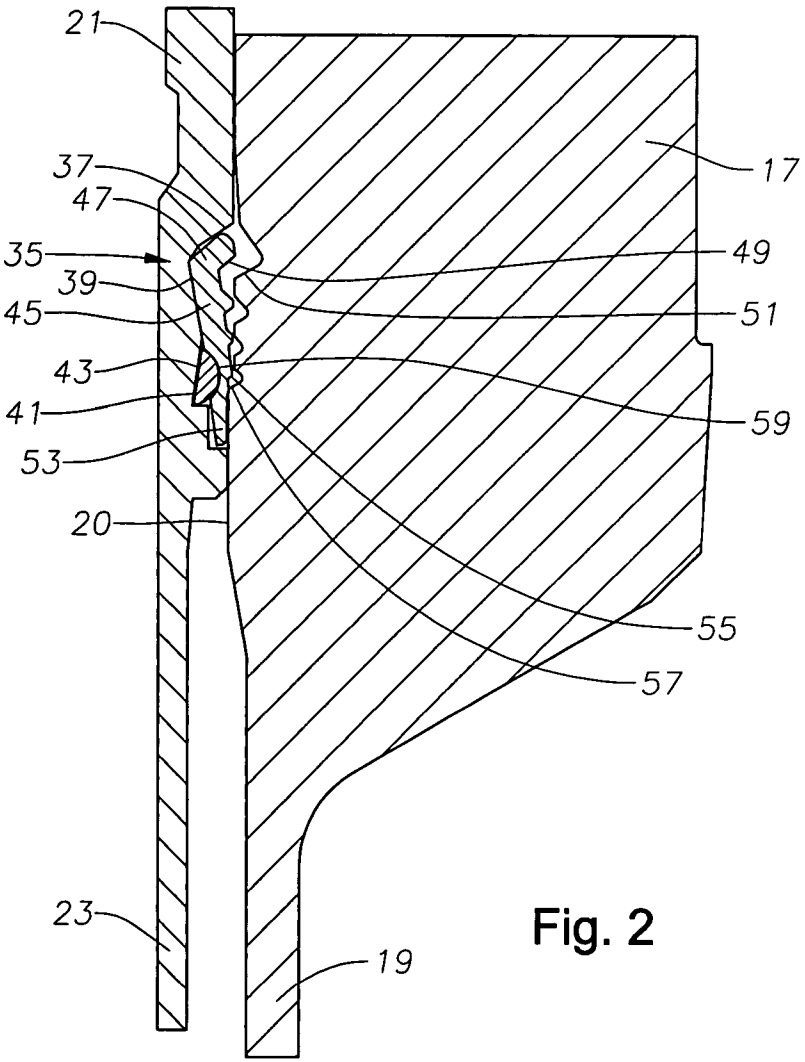
FIG. 2 is an enlarged sectional view of a portion of the wellhead assembly shown in FIG. 1, with a collet ring assembly constructed in accordance with this invention shown in its unlocked position.

A hanger landing assembly 35 engages bore 20 of high pressure wellhead housing 17 and supports casing hanger 21 and first string of intermediate casing 23. Referring to FIGS. 2 and 3, hanger landing assembly 35 includes a hanger recess 37 formed along the outer circumference of casing hanger 21. Hanger recess 37 preferably includes an inclined portion 39 and a tapered portion 41. In the preferred embodiment, inclined portion 39 is angled so that the axially upper portion of inclined portion 39 has a smaller circumference than the axially lower portion of inclined portion 39. In the preferred embodiment, tapered portion 41 is oppositely angled so that the upper portion of tapered portion 41 has a larger outer circumference than the lower portion of tapered portion 41. The lower portion of inclined portion 39 intersects the upper portion of tapered portion 41.

A back-up ring 43 is preferably positioned around the circumference of hanger 21 to slidingly engage tapered portion 41 of hanger recess 37. Back-up ring 43 slides axially upward and downward relative to tapered portion 41. In the preferred embodiment, back-up ring 43 is a split c-ring, which allows back-up ring 43 to expand and contract as back-up ring 43 slidingly engages tapered portion 41. In the preferred embodiment, back-up ring 43 has a semi-hemispherical cross section with the flat portion of the semi-hemispherical cross section engaging tapered portion 41 and the arcuate portion engaging the interior diameter of a collet 45.

Collet 45 extends around the outer circumference of casing hanger 21 and hanger recess 37. Referring back to FIGS. 2 and 3, collet 45 includes an upper portion 47 having a plurality of ribs or protrusions 49 along its outer circumference. Protrusions 49 of upper portion 47 preferably engage a grooved profile 51 formed in wellhead housing 17 when collet 45 is expanded to its locked position shown in FIG. 3. Protrusions 49 do not engage grooved profile 51 when collet 45 is in its retracted and unlocked position. Collet 45 also has an upper end or rim that is conical for engaging a downward facing conical surface of hanger recess 37.

Collet 45 also preferably includes a lower portion 53 having a rib or protrusion 55 extending therefrom. In this embodiment, an upward facing locator ledge 57 is formed at the lower end of grooved profile 51. Protrusion 55, while in its unlocked position shown in FIG. 2, preferably has an outer circumference that allows protrusion 55 to slide axially downward through the upper portion of bore 20 located above grooved profile 51. The outer circumference of protrusion 55, while in the expanded position, is slightly greater than the inner diameter of locator ledge 55, causing protrusion 55 to land and engage upper facing ledge 57 as casing hanger 21 slides axially downward through bore 20 of wellhead housing 17. Collet 45 preferably includes an arcuate recess or inner face 59 that slidingly engages the arcuate portion of semi-hemispherical back-up ring 43. Inner face 59 is preferably located below a centerline located halfway between the upper and lower ends of collet 45.

Figure 4:
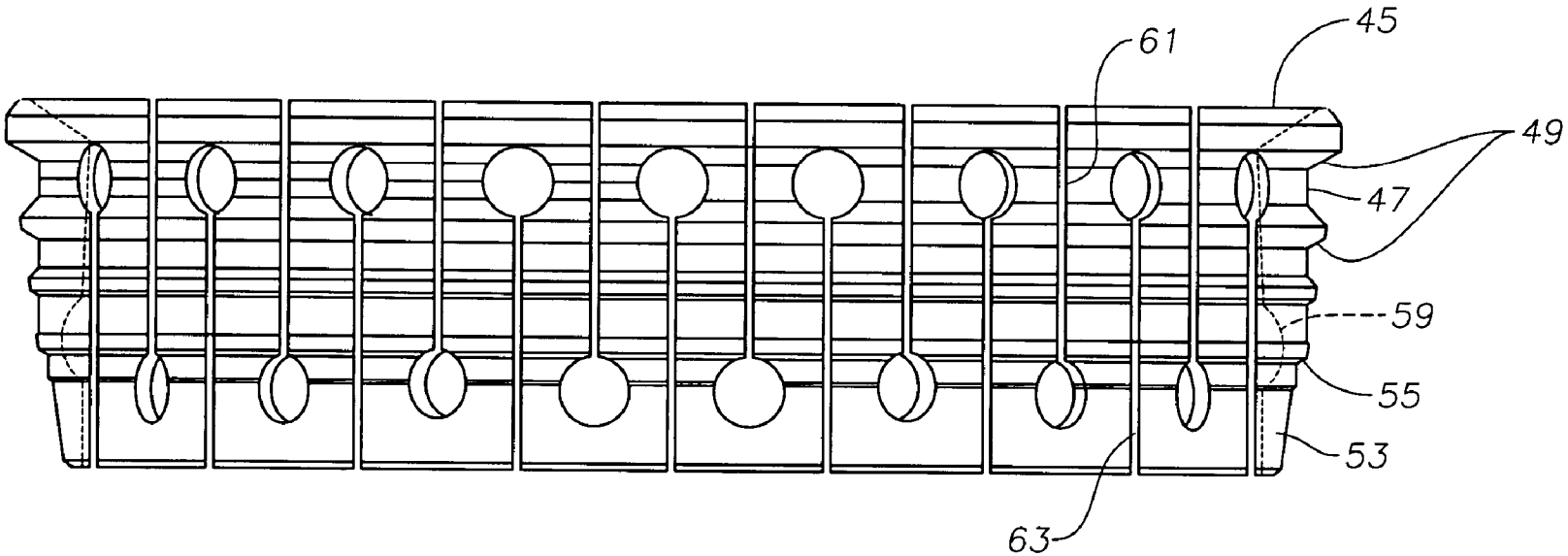
FIG. 4 is a perspective view of a collet for the collet ring assembly shown in FIGS. 2 and 3.

Referring to FIG. 4, collet 45 has a plurality of spaced apart upper slots 61 extending from its upper surface a predetermined length toward the lower surface of collet 45. Collet 45 preferably also includes a plurality of lower slots 63 extending from the lower surface of collet 45 toward the upper surface of collet 45. Upper and lower slots 61, 63 allow upper portion 47 of collet 45 to expand radially outward and allow lower portion 53 to contract radially inward as collet 45 rotates around back-up ring 43 between the unlocked and locked positions shown in FIGS. 2 and 3.

In operation, low pressure wellhead housing 13 and conductor casing 15 are landed and cemented into place. High pressure wellhead housing 17 and its string of casing 19 are then landed and cemented into place within low pressure wellhead housing 13. The collet ring assembly, including back-up ring 43 and collet 45, are connected to the outer circumference of hanger 21. Intermediate string of casing 23 is suspended from the lower end of casing hanger 21, which is then lowered into bore 20 of wellhead housing 17. First intermediate string of casing 23 and casing hanger 21 are lowered into bore 20 of high pressure wellhead housing 17 until collet 45 aligns with grooved profile 51.

As casing hanger 21 is lowered through bore 20 of high pressure wellhead housing 17 and is approaching grooved profile 51, collet 45 is in its unlocked or retracted position shown in FIG. 2. In the unlocked position shown in FIG. 2, upper portion 47 of collet 45 is retracted within hanger recess 37 so that collet 45 can slide axially through the inner circumference of bore 20 of wellhead housing 17. Upon reaching recess 21, lower protrusion 55 of collet 45 lands on and engages locator ledge 57 at the base of grooved profile 51. Locator ledge 57 prevents collet 45 from sliding axially downward relative to bore 20 beyond grooved profile 51. As casing hanger 21 continues to slide axially downward relative to bore 20 in wellhead housing 17, hanger 21 also slides axially downward relative to collet 45 and back-up ring 43.

Back-up ring 43 slidingly engages tapered portion 41 of hanger recess as casing hanger 21, which continues to slide axially downward. The slope of tapered portion 41 pushes back-up ring 43 radially outward as casing hanger 21 slides axially downward relative to collet 45 and back-up ring 43. Back-up ring 43 exerts a radially outward force upon the interior surface of collet 45 as the flat portion of back-up ring 43 slides relative to tapered portion 41 of hanger recess 37. Arcuate inner face 59 allows collet 45 to rotate around the arcuate portion of the semi-hemispherical cross-sectioned back-up ring 43 as back-up ring 43 expands radially outward, thereby forcing upper portion 47 of collet 45 into engagement with grooved profile 51 of wellhead housing 17. When upper portion 47 of collet 45 is rotated into engagement with grooved profile 51 of wellhead housing 17, as shown in FIG. 3, casing hanger 21 is landed and locked into position within bore 20 of wellhead housing 17 to support first intermediate string of casing 23. The load on casing hanger 21 transfers through the conical upper rim of collet 37 and through protrusions 49 of collet 45 to grooves 51 in wellhead housing 17. Very little of the load passes through locator ledge 57, thus is may be very small in radial width.

In the unlikely event it is necessary to remove casing hanger 21 from wellhead housing 17, the operator simply lifts casing hanger 21 out of bore 20. As casing hanger 21 is lifted out of bore 20, back-up ring 43 slides axially downward relative to tapered portion 41 of hanger recess 37, which allows upper portion 47 of collet 45 to rotate to its retracted position out of engagement with grooved profile 51, thereby unlocking casing hanger 21 from bore 20 of high pressure wellhead housing 17.

Figure 6:
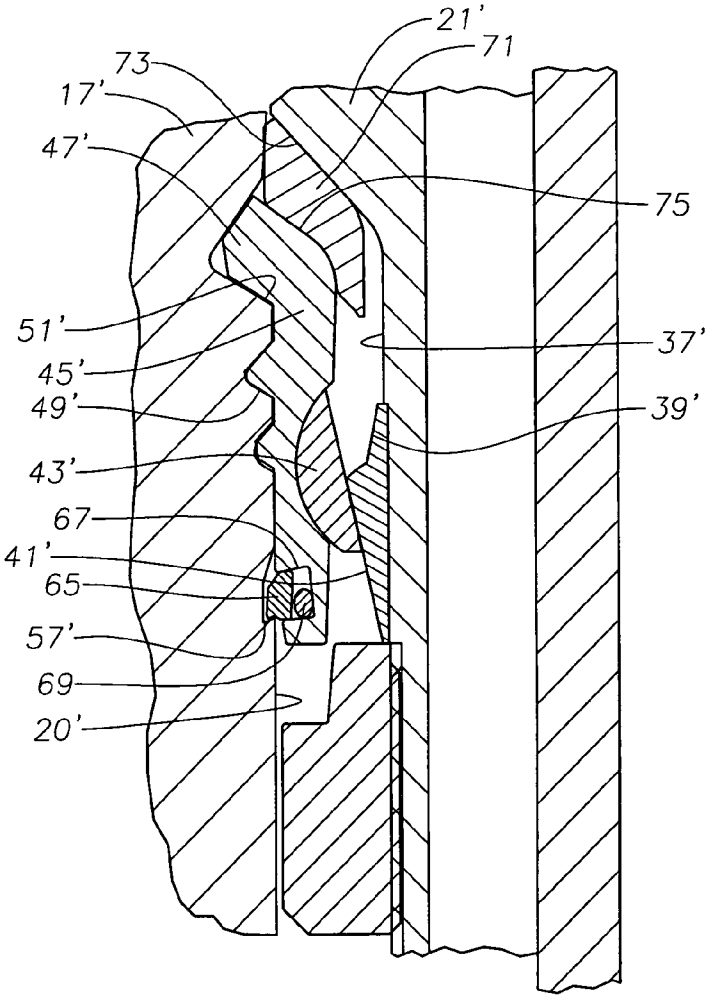
FIG. 6 is an enlarged sectional view of the collet ring assembly of FIG. 5, shown in its locked position.
Figure 5:
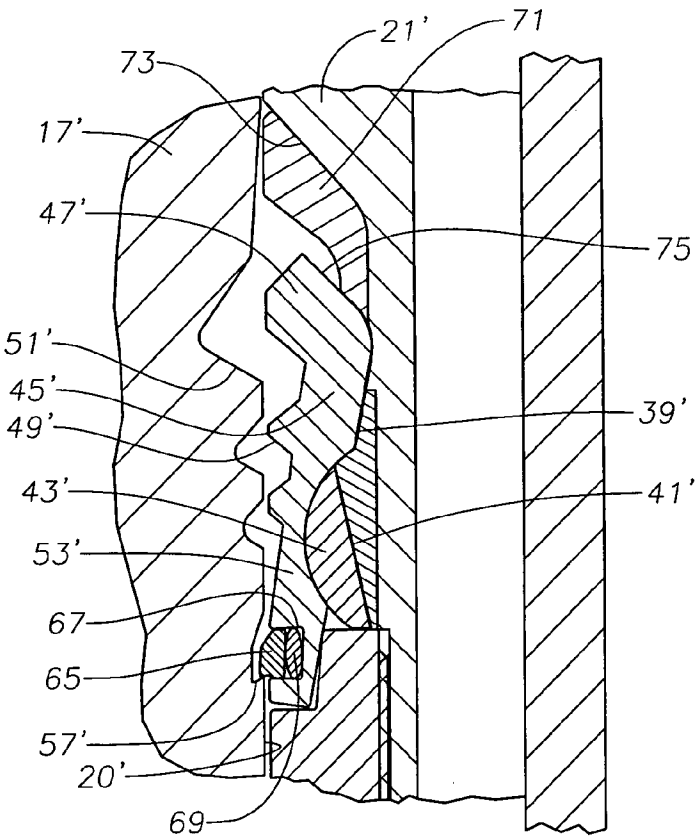
FIG. 5 is an enlarged sectional view of an alternative embodiment of the collet ring assembly of FIG. 2, and shown in its unlocked position.

Referring to FIGS. 5 and 6, in an alterative embodiment, a split hanger ring 65 is located within a hanger slot 67 extending around the outer circumference of lower portion 53' of collet 45'. Hanger ring 65 extends radially outward from lower portion 53' of collet 45' to engage upward facing ledge 57' of wellhead housing 17. An energizer ring 69, preferably made of an elastomeric material, is located within hanger slot 67 to maintain a radially outward force on hanger ring 65 so that hanger ring 65 extends radially outward to engage upward facing ledge 57.

Also, in this embodiment, tapered surface 41' is a separate ring that is rigidly mounted on casing hanger 21', rather than machined as in the first embodiment. Furthermore, a load ring 71 is optionally located between conical shoulder 73 of hanger recess 37' and conical upper rim 75 of collet 45'. Load ring 71 is a c-ring. Collet 45' is shown in its unlocked and retracted position in FIG. 5, and in its locked and expanded position in FIG. 6.

In operation, collet 45' of FIGS. 5 and 6 operates substantially similar to the embodiment shown in FIGS. 2 and 3. As casing hanger 21' is lowered into bore 20' of wellhead housing 17', hanger ring 65 locates and engages upward facing ledge 57'. Hanger ring 65 prevents collet 45' from continuing downward relative to grooved profile 51' of wellhead housing 17'. As casing hanger 21' continues to move axially downward relative to bore 20' and grooved profile 51, back-up ring 43' slides axially upward and radially outward along wedge ring 41' of hanger recess 37', thereby forcing upper portion 47' of collet 45' into engagement with grooved profile 51' of wellhead housing 17'.

While the invention has been shown in only some of its forms, it should be apparent to those skilled in the art that it is not so limited, but is susceptible to various changes without departing from the scope of the invention. For example, in all the embodiments shown, three protrusions 49 extend radially outward from upper portion 47 of collet 45. Alternatively, any number of protrusions 49 can be formed on upper portion 47 of collet 45 to engage a desired number of grooves within grooved profile 51 as needed.

That claimed is:

1. A subsea wellhead assembly, comprising:

a tubular wellhead member having a bore;

a recess formed in the bore and having an upward facing ledge;

a hanger for supporting a string of conduit;

a collet located on an outer surface of the hanger, the collet having a protruding lower portion that extends radially outward from the hanger and engages the ledge of the recess, the collet having an upper portion that rotates radially outward and engages the recess as the hanger slides axially downward after the protruding lower portion of the collet engages the upward facing ledge; and a back-up ring located between the collet and the hanger for rotating the upper portion of the collet radially outward.

2. The wellhead assembly of claim 1, wherein the back-up ring has a hemispheric cross-section and is positioned so that the flat portion slidingly engages the hanger and the arcuate portion engages the collet when the hanger slides axially downward after the collet engages the upward facing ledge.

3. The wellhead assembly of claim 1, wherein the back-up ring is a split ring.

4. A subsea wellhead assembly, comprising:

a tubular wellhead member having a bore;

a recess formed in the bore and having an upward facing ledge;

a hanger for supporting a string of conduit; and a collet located on an outer surface of the hanger, the collet having a protruding lower portion that extends radially outward from the hanger and engages the ledge of the recess, the collet having an upper portion that rotates radially outward and engages the recess as the hanger slides axially downward after the protruding lower portion of the collet engages the upward facing ledge;

a tapered surface formed along the outer circumference of the hanger which slides axially downward relative to the collet after the protruding lower portion of the collet engages the upward facing ledge to rotate the upper portion of the collet radially outward; and a back-up ring that rotates the upper portion of the collet while slidingly engaging the tapered surface of the hanger.

5. A subsea wellhead assembly, comprising:

a tubular wellhead member having a bore;

a recess formed in the bore and having an upward facing ledge;

a hanger for supporting a string of conduit that is lowered into the bore;

a tapered surface formed along the outer circumference of the hanger;

a collet located around the circumference of the casing hanger, the collet having a protruding lower portion extending radially outward from the hanger for locating and engaging the upward facing ledge and an upper portion for engaging the recess; and a back-up ring located between the tapered surface and the collet that slidingly engages the tapered surface of the hanger to rotate collet so that the upper portion of the collet rotates radially outward and matingly engages the recess as the hanger slides axially downward after the protruding lower portion of the collet engages the upward facing ledge.

6. The wellhead assembly of claim 5, wherein the tapered surface slides axially downward relative to the back-up ring after the protruding lower portion of the collet engages the upward facing ledge to rotate the upper portion of the collet radially outward.

7. The wellhead assembly of claim 5, wherein the lower portion of the tapered surface has a smaller circumference than the upper portion of the axially tapered surface.

8. The wellhead assembly of claim 5, wherein the back-up ring has a hemispheric cross-section and is positioned so that the flat portion slidingly engages the tapered surface and the arcuate portion engages the collet when the hanger slides axially downward after the collet engages the upward facing ledge.

9. The wellhead assembly of claim 5, wherein the back-up ring is a split ring.

10. The wellhead assembly of claim 5, further comprising a plurality of protrusions formed around the outer circumference of the upper portion of the collet for engaging the recess.

11. The wellhead assembly of claim 5, further comprising a plurality of grooves formed around the inner circumference of the recess for engaging the upper portion of the collet.

12. The wellhead assembly of claim 5, wherein the lower portion of the collet further comprises a hanger ring protruding radially outward for engaging the upward facing ledge.

* * * * *